US007658641B1

(12) United States Patent
Maxwell et al.

(10) Patent No.: US 7,658,641 B1
(45) Date of Patent: Feb. 9, 2010

(54) COMPRESSIVE COLLET ELECTRICAL CLAMP AND CONTACT AND METHOD

(75) Inventors: Scott D. Maxwell, Renton, WA (US); Raymond Q. Draggie, Renton, WA (US); Marian D. Maxwell, Renton, WA (US); Charles A. Lemaire, Apple Valley, MN (US)

(73) Assignee: Mechanical Answers LLC, Renton, WA (US)

( * ) Notice: Subject to any disclaimer, the term of this patent is extended or adjusted under 35 U.S.C. 154(b) by 0 days.

(21) Appl. No.: 11/900,409

(22) Filed: Sep. 10, 2007

Related U.S. Application Data

(60) Provisional application No. 60/825,115, filed on Sep. 8, 2006.

(51) Int. Cl.
*H01R 9/05* (2006.01)

(52) U.S. Cl. ..... 439/548

(58) Field of Classification Search ..... 439/803, 439/427, 578–585, 675
See application file for complete search history.

(56) References Cited

U.S. PATENT DOCUMENTS

| | | | | |
|---|---|---|---|---|
| 3,491,329 | A | 1/1970 | Lecocq | |
| 3,744,007 | A * | 7/1973 | Horak | 439/394 |
| 4,739,126 | A * | 4/1988 | Gutter et al. | 174/78 |
| 4,929,191 | A | 5/1990 | Dufresne | |
| 5,108,301 | A | 4/1992 | Torok | |
| 5,314,359 | A | 5/1994 | Probst | |
| 5,704,814 | A | 1/1998 | McCarthy | |
| 5,775,934 | A | 7/1998 | McCarthy | |
| 5,809,619 | A | 9/1998 | Schaub | |
| 5,839,924 | A | 11/1998 | Ritson | |
| 6,123,567 | A | 9/2000 | McCarthy | |
| 6,202,300 | B1 | 3/2001 | Yuzwalk | |
| 6,773,037 | B2 | 8/2004 | Spurgat | |
| 6,832,925 | B2 | 12/2004 | Draggie et al. | |
| 7,052,331 | B2 | 5/2006 | Maxwell et al. | |
| 7,182,615 | B1 | 2/2007 | Liu | |

* cited by examiner

*Primary Examiner*—Edwin A. Leon
(74) *Attorney, Agent, or Firm*—Charles A. Lemaire; Jonathan M. Rixen; Lemaire Patent Law Firm, P.L.L.C.

(57) ABSTRACT

The present invention provides a barrel clamp apparatus integrated with an electrical contact, which, with the application of a mating compression nut provides a method of clamping the contact to an electrical cable. In some embodiments the electrical contact is configured to mate with a tapered battery post and in others the electrical contact is a pin or socket arrangement whose wire receiving end has been configured with a barrel clamp configuration. In one embodiment the barrel clamp has been integrated into a band clamp battery connector assembly. In all embodiments this device provides a positive means of securing an electrical cable to an electrical contact, maximizing the conductive potential and clamping force to ensure the best electrical and physical connection is made.

20 Claims, 6 Drawing Sheets

100
110
111
120
121
122
123
127
128
130
131
132
135

COMPRESSIVE COLLET ELECTRICAL CLAMP AND CONTACT AND METHOD

CROSS-REFERENCE TO RELATED APPLICATIONS

This application claims benefit to U.S. Provisional Patent Application 60/825,115 entitled "COMPRESSIVE COLLET ELECTRICAL CLAMP AND CONTACT AND METHOD", filed Sep. 8, 2006 by Scott D. Maxwell, Raymond Q. Draggie, Marian D. Maxwell, and Charles A. Lemaire, which is incorporated by reference in its entirety.

FIELD OF THE INVENTION

This invention relates to the field of cable clamps and more specifically to a cable clamp that is integrated in combination with battery connector contact to provide means of connection and repeatable of a power system cable to a battery connector.

BACKGROUND OF THE INVENTION

Methods of attaching a power cable to a battery connector have historically employed one of several different means including crimping the connector barrel to the cable, clamping the cable to a connector with a split clam shell cable connector barrel, securing into the barrel with a set screw arrangement, or soldering the cable into the connector barrel.

Each of the mentioned methods of attachment are re-used from previous electrical connectors so cannot be considered novel. Each method also has built in problems associated with their designs which may be encouragement to look for other means of attachment.

Crimping has the disadvantage of only making positive electrical contact at the sites of greatest crimp compression not in a uniform manner. Clamping the cable with a split clam shell cable barrel arrangement requires at least 2 bolts and nuts making it somewhat unhandy. Securing a wire with a connector with a set screw arrangement, though commonly done makes positive contact at the site of the set screw, however, over time the wire strands will tend to migrate away from the concentrated force of the screw so may eventually have poor contact at that site. Soldering may provide imperfect connection of the connector to the cable if the conditions, including material temperature and cleanliness are not proper for this type of bonding, resulting in a cold solder joint.

It is therefore desirable to use a means of cable attachment that avoids all of the down falls of the aforementioned methods.

SUMMARY OF THE INVENTION

The present invention provides a means of attaching a power cable to a battery connector which avoids the drawbacks of methods historically used for this purpose. The primary object of this invention is to provide means for making a positive, uniform connection that maximizes surface area contact and surface area friction such that the connection is mechanically secure and electrically connected. Secondarily it is the object of this invention to provide means for simple release of the cable from the connector. This invention claims a compressive connector whose barrel is both threaded a split such that when the cable has been inserted into the barrel and an internally tapered external nut is tightened, the split barrel tightens onto the inserted cable.

As the entire barrel is tightened onto the cable the objective of clamping maximum surface area to ensure maximum electrical contact and maximum surface friction is accomplished. Also given that only a single nut must be turned to repeatedly tighten or loosen the connection to the cable is also accomplished. Given that there is a simple means of release it provides the battery connector with the ability to be connected to a wide variety of cable configurations and the ability to also act as an after market retrofit product.

The collet cable connectors shown in the attached drawing can be combined, in whole or in part, with any of the battery cable connectors or parts described in U.S. Pat. No. 7,052,331, issued May 30, 2006, which is incorporated herein by reference in its entirety.

DESCRIPTION OF EMBODIMENTS

Figures 1A, 1B, 1C, 1D, 1E, 1F, 1G, 1H:
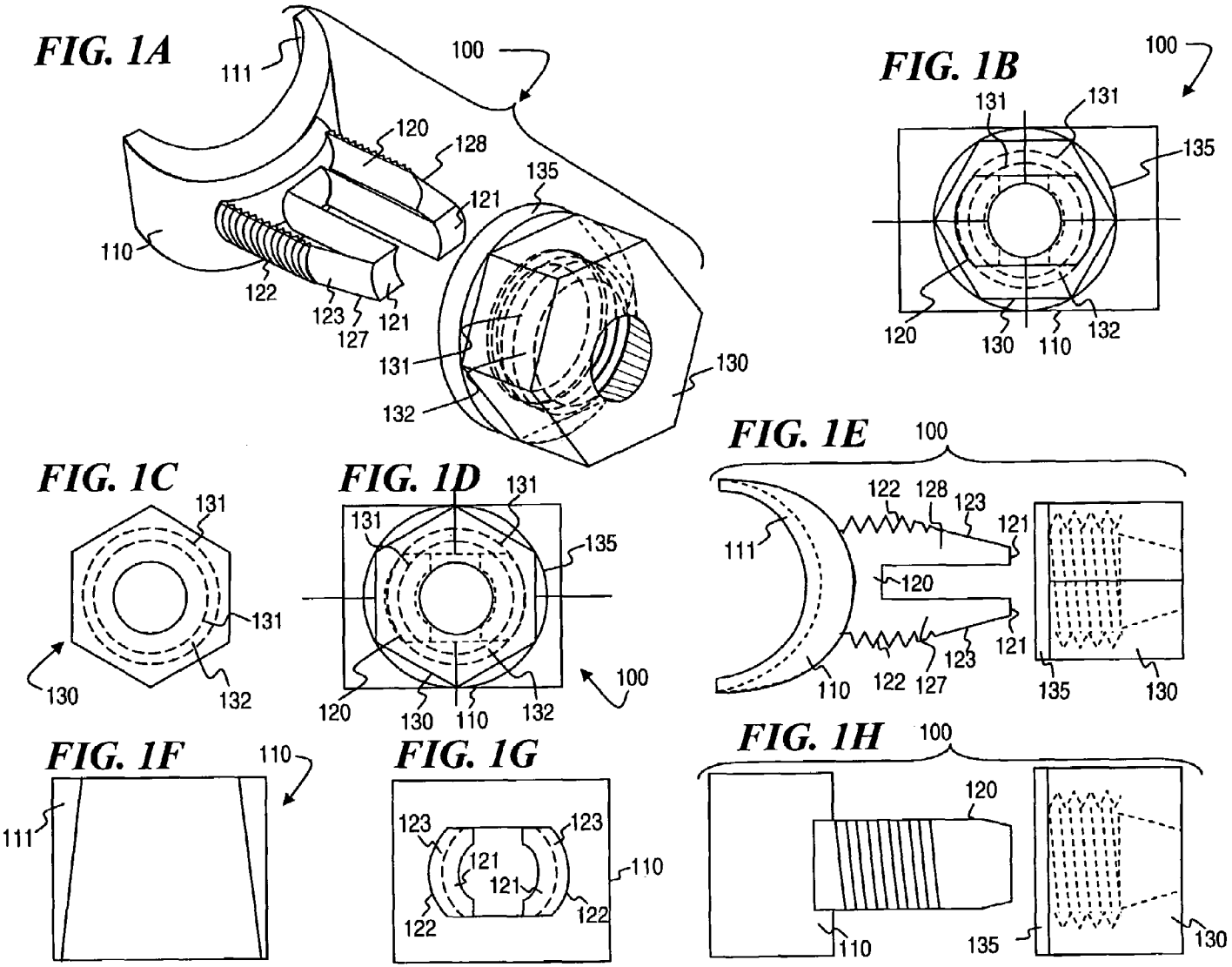
FIG. 1A is a perspective view that illustrates an assembly which combines a split barrel cable clamp with a battery connector electrical contact to provide a conductive path from a battery to an electrical power cable.
FIG. 1B is a cross-sectional view of the FIG. 1A assembly illustrating the relative position of the split barrel clamp and the electrical contact to the internal features of the compression nut and to the circular collar.
FIG. 1C illustrates the relative dimensions of the external hexagonal tool reception surface, the internal threads, and the taper within the compression nut of the FIG. 1A assembly.
FIG. 1D depicts the same cross-sectional view depicted in FIG. 1B except that the compression nut is rotated thirty degrees.
FIG. 1E provides a plan view of the FIG. 1A assembly including the electrical contact, the split barrel clamp, the compression nut (the compression nut is rotated thirty degrees compared to the alignment of the compression nut in FIG. 1A), and the circular collar.
FIG. 1F is an end-on view of the electrical contact shown in FIG. 1A. The curved inside edge of the electrical contact is also depicted.
FIG. 1G is an end-on cross-sectional view of the FIG. 1A assembly illustrating the electrical contact, and the external threads and the external taper of the split barrel clamp.
FIG. 1H is a side-view of the FIG. 1A assembly illustrating the electrical contact, the split barrel clamp, and the compression nut (the compression nut is rotated thirty degrees compared to the alignment of the compression nut in FIG. 1A).

In the following detailed description of the preferred embodiments, reference is made to the accompanying drawings that form a part hereof, and in which are shown by way of illustration specific embodiments in which the invention may be practiced. It is understood that other embodiments may be utilized and structural changes may be made without departing from the scope of the present invention.

The leading digit(s) of reference numbers appearing in the Figures generally corresponds to the Figure number in which that component is first introduced, such that the same reference number is used throughout to refer to an identical component which appears in multiple Figures. Signals and connections may be referred to by the same reference number or label, and the actual meaning will be clear from its use in the context of the description.

One solution to the problem of providing means for quick, simple and positive electrical connection from an electrical contact to an electrical cable is by use of a novel split barrel-clamping arrangement. As used herein, a barrel clamp is a tapered member having an interior space that compresses against a cable or other male member that is inserted within the barrel clamp. In some embodiments, a split barrel clamp is used wherein the barrel clamp has one or more slots that define one or more arms which compress around the inserted cable. That is, a single slot would yield a compressible arm that when compressed by a compression nut reduces the interior space, thus clamping on the cable. Likewise, two slots would yield two compressible arms, and three slots would provide three compressive arms, etc.

This barrel-clamping arrangement when integrated with a battery connector electrical contact provides a conductive electrical path from the electrical cable to the contact which has several advantages over other means. As used herein, "integrated with" means forms a single unitary piece, such as a single cast piece of metal, or two or more pieces welded into a single piece. This arrangement maximizes surface area contact of the cable to the inside of the clamping barrel which in turn maximizes electrical conduction and clamping friction. Given the clamping is largely uniform the formation of hot spots due to non-uniform conduction will not take place. Mechanical vibration will also have less impact on the connection being made as the connection is not reliant on a small section of the stripped conductive portion of the cable, rather the majority of this cable area is made use of to maintain a positive physical connection. Described in this application are applications relating to battery cable connectors.

In conjunction with maximizing surface contact the barrel clamp arrangement also maximizes internal cable contact. A cable is made up of individual strands which have space between them. If they are not clamped uniformly much of the surface area of each internal strand will not be involved in conduction. When the cable is clamped uniformly along its length, given enough force is applied, the maximum amount strand surface area will be brought into contact with the other strand thus maximizing the conductive potential of this portion of the cable. Other cable clamping methods such as the set screw arrangement, crimps, etc. tend to clamp at a single point on the cable and not in a uniform manner at that point. This tends to reduce the conductive potential of the electrical assembly and a hot spot may be formed as all of the strands are not conducting so resistance is increased possibly reducing the life of the cable as well. This may also compromise the system electrical current is being supplied to as during peak demand sufficient electrical current may not be supplied. It also has potential to be a Safety Hazard as when hot spots are formed, oxidation may take place further increasing electrical resistance resulting in a positive feedback cycle resulting in arcing or wire burn-out. The barrel clamp arrangement will tend to avoid these problems.

Another element of this device is the ease and ability to secure the cable to the electrical contact by tightening one tapered nut. This also provides the user with the ability to loosen and remove the cable for inspection or connector replacement. This aspect also makes this device ideal for retrofitting electrical connectors.

This is not intended to restrict the split barrel electrical clamp to a battery cable connector as it has a much larger application to other electrical connectors and contact types. However, there is a need in the field of battery connectors for device which provides ease of attachment and release, maximum electrical and maximum physical contact while maximizing conductive potential.

FIG. 1A is a perspective view that illustrates an assembly 100 which combines a split barrel cable clamp 120 with a battery connector electrical contact 110 to provide a conductive path from a battery to an electrical power cable. In some embodiments, the electrical contact 110 includes a curved inside edge 111 that conforms the contact 110 around a conically-shaped battery post. In some embodiments, the curved inside edge 111 includes a negative (female) conical taper to match the positive (male) conical frustum taper of the battery post. In some embodiments, the contact 110 is made from relatively soft and/or thin material (e.g., copper), and can accommodate both a (+) or (−) battery post. In some embodiments, the contact 110 is made from a tin-coated brass. Tin is galvanometrically similar to lead so galvanic corrosion is therefore minimized.

In some embodiments, the split barrel clamp 120 has external threads 122 which receive and mate with internal threads 131 of the compression nut 130. In some embodiments, as shown in FIG. 1A, the split barrel clamp 120 is split (at least partially) into two arms 127 and 128, that are forced toward one another when compression nut 130 is tightened on the split barrel clamp 120. In some embodiments, the compression nut 130 includes a circular collar 135 which prevents the hex points of the compression nut 130 from contacting the surface of the battery. In some embodiments, the compression nut 130 is made from a non-metallic material (e.g., a composite polymer with glass or carbon fiber filler). The use of a non-metallic material can less expensive than brass, and it can be used to provide electrical insulation. In some embodiments, the internal threads 131 of the compression nut 130 extend further than the required length in order to prevent jamming of threads when the compression nut 130 is tightened. In some embodiments, the hole in the compression nut 130 is beveled (i.e., chamfered) such that the compression nut 130 can receive an electrical cable. In some embodiments, the bore of the hole in the compression nut 130 has a diameter that is (at minimum) equivalent to the electrical cable diameter plus 0.010 inches in order to insure that the electrical cable will insert easily. In some embodiments, the compression nut 130 includes a hexagonal tool reception surface that has the same outside diameter as the rest of nut 130. This provides maximum strength and avoids interference with the battery.

In some embodiments, the electrical contact 110 and the barrel clamp 120 are made in two (or more) pieces. For example, in some embodiments, the barrel clamp 120 includes a body having a threaded (or non-threaded) post on the contact end such that the barrel clamp 120 is mated with a threaded (or non-threaded hole) through the electrical contact 110. In some embodiments, the two parts are assembled through the band clamp. This provides the advantages of allowing a smaller hole through the band.

In some embodiments, the split barrel clamp 120 has an externally tapered end 123 which is inserted into an internal taper 132 within the compression nut 130. The end faces 121 of the barrel clamp 120 are also depicted in FIG. 1A. In some embodiments, the taper 132 of the compression nut 130 is greater than the taper 123 of the barrel clamp 120 such that when the electrical cable is inserted through the hole in the compression nut 130 and into the barrel clamp 120, and the compression nut 130 is tightened onto the barrel clamp 120, the barrel clamp 120 compresses the electrical cable. This manner of compression provides a substantially uniform clamping force along the length of the barrel clamp 120. In some embodiments, the barrel clamp 120 includes a narrow bore at the electrical contact end of the clamp 120 in order to increase compression at that end. In some embodiments, the taper 123 of the barrel clamp 120 is shallow enough such that the clamping surface area is maximized and such that the barrel clamp 120 is prevented from jamming into the nut 130. In some embodiments, the barrel clamp 120 includes an inner grip that ensures that the electrical cable is held in place during operation. In some embodiments, for example the inner grip is sloped such that it allows cable entry but bites on withdrawal of the cable. In some embodiments, the inner grip is threaded into the barrel clamp 120.

In some embodiments, the electrical cable is twisted prior to inserting it into the split barrel clamp 120 in order to prevent wire strands from aligning parallel to the slots of the barrel clamp 120 (thereby preventing the wire strands from escaping out the slots). In some embodiments, an adaptor sleeve is inserted into the barrel clamp 120 and crimped (or pre-crimped to cable before insertion to barrel clamp 120) onto smaller cable to adapt it for the barrel clamp 120's bore size. In some embodiments, the crimp is uniform in order to maintain round shape to allow insertion into the barrel clamp 120.

FIG. 1B is a cross-sectional view of the assembly 100 showing the relative position of the split barrel clamp 120 and the electrical contact 110 to the internal features of the compression nut 130 and to the circular collar 135. The internal threads 131 of the compression nut 130 and the internal taper 132 of the compression nut 130 are also depicted.

FIG. 1C shows the relative dimensions of the external hexagonal tool reception surface, the internal threads 131, and the taper 132 within the compression nut 130. In some embodiments, the hexagonal tool reception surface is placed on the compression nut 130 where the greatest material strength is. For example, in some embodiments, the widest part of the hexagonal tool reception surface is the same dimension as the diameter of the round part of the compression nut 130.

FIG. 1D shows the same cross-sectional view of assembly 100 shown in FIG. 1B except that the compression nut 130 is rotated thirty degrees.

FIG. 1E provides a plan view (top view) of the assembly 100 including the electrical contact 110, the split barrel clamp 120 (along with arms 127 and 128), the compression nut 130 (the compression nut 130 is rotated 30 degrees compared to the alignment of the compression nut 130 in FIG. 1A), and the circular collar 135. The end-faces 121 and the external threads 122 are also depicted. When the compression nut 130 is loosened such that the its internal taper 132 is no longer applying force on the external taper 123 of the split barrel clamp 120, the electrical cable may be inserted along the centerline of the nut 130 and barrel clamp 120, through the nut 130 into the barrel clamp 120. When the nut 130 is tightened, force is applied along the entire length of the split barrel clamp 120, clamping the cable into the barrel clamp 120. This manner of clamping will provide a substantially uniform clamping force along the length of the barrel clamp 120.

FIG. 1F is an end-on view of the electrical contact 110. The curved inside edge 111 is depicted.

FIG. 1G is an end-on cross-sectional view illustrating the electrical contact 110, and the external threads 122 and the external taper 123 of the split barrel clamp 120. The end faces 121 of the barrel clamp 120 are also depicted.

FIG. 1H is a side-view of assembly 100 illustrating the electrical contact 110, the split barrel clamp 120, and the compression nut 130 (the compression nut 130 is rotated 30 degrees compared to the alignment of the compression nut 130 in FIG. 1A).

Figure 2B:
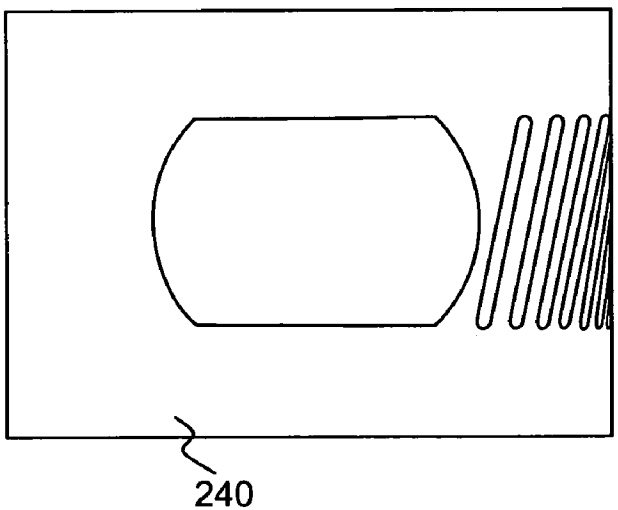
FIG. 2B illustrates the band of the FIG. 2A band clamp and it depicts the hole cut through the center of the band.
Figure 2A:
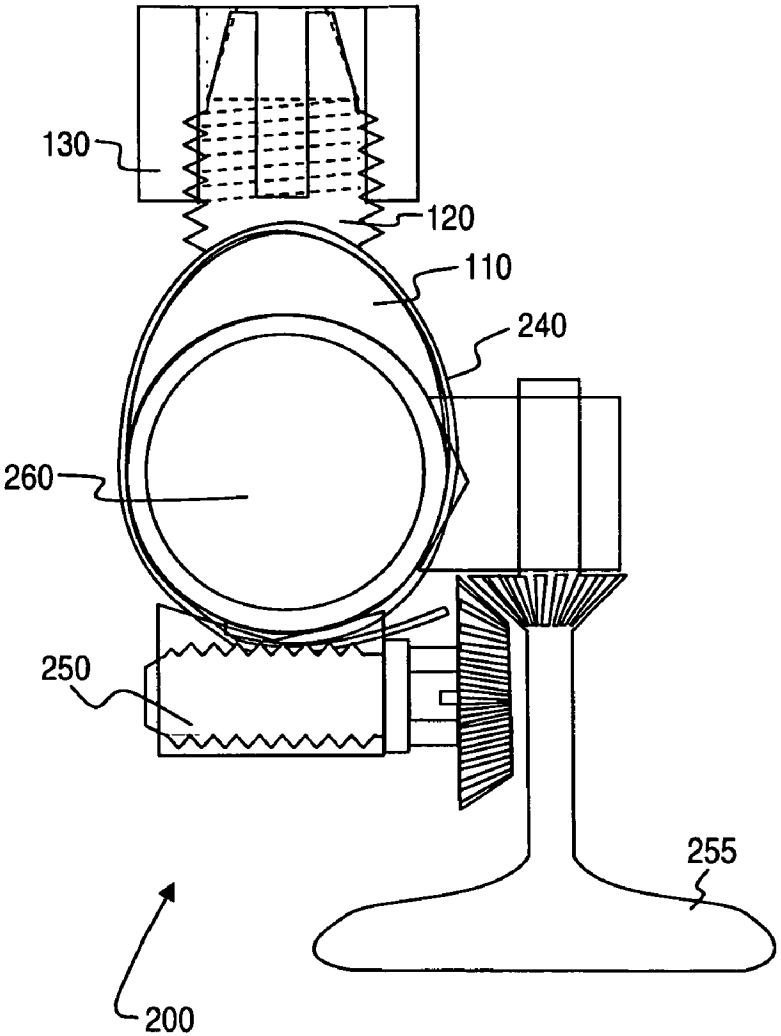
FIG. 2A illustrates an assembly comprised of the FIG. 1A assembly integrated with a band clamp battery connector attached to a battery post.

FIG. 2A illustrates an assembly 200 comprised of assembly 100 integrated with a band clamp battery connector attached to a battery post 260. The band clamp comprised of the band 240, a worm drive adjustment screw 250, a lobed handle 255, and gears for driving the adjustment screw 250 with the handle 255 is assembled in combination with the electrical contact 110, the split barrel clamp 120 and the compression nut 130. In some embodiments, the screw 250 is placed at varying angles to make it accessible in a wide variety of battery spaces (i.e., offer different battery configurations). In some embodiments, the screw 250 is a beveled gear such that a ninety-degree approach can be achieved. In some embodiments, a mechanically advantaged, hand-tight-enable battery clamp includes the beveled gear. In some embodiments, the beveled gear shaft includes a screw head in place of the lobed handle 255 and the gears.

The band 240 of the band clamp has a hole cut through its center which allows the split barrel clamp 120 to pass through. The electrical contact 110 remains on the inside of the band 240 as it is too large to pass through. In some embodiments, the electrical contact 110 is attached to the band 240 with a fastener such as a rivet. In some embodiments, the hole that is cut through the band 240 is cut with flatted (i.e., flattened) sides in order to leave a wider portion of the band 240 on each side of the split barrel clamp 120. This can also help prevent rotation of the assembly 100 when the compression nut 130 is tightened to secure the electrical cable within the split barrel clamp 120. In some embodiments, the flatted hole is configured such that it spaces the electrical contact 110 and the compression nut 130 at least ⅛ inch from the battery surface.

FIG. 2B illustrates the band 240 of the band clamp and shows the hole cut through its center. This hole is cut to accommodate the split barrel clamp 120 and allow it to pass through. When the assembly 100 is in place the flatted sides of the split barrel clamp 120 mates with the flatted sides of the cut hole. This prevents the barrel clamp 120 from having a tendency to rotate when the compression nut 130 is tightened onto the barrel clamp 120.

Figure 3B:
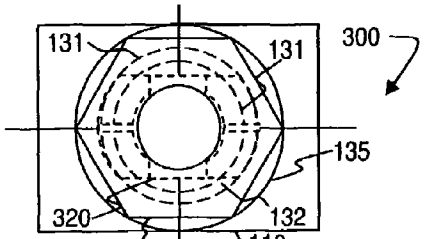
FIG. 3B is a cross-sectional view of the FIG. 3A assembly showing the relative position of the split barrel clamp and the electrical contact 110 to the internal features of the compression nut and to the circular collar 135.
Figure 3C:
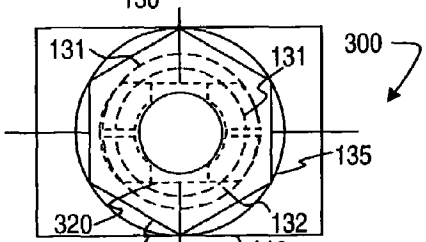
FIG. 3C depicts the same cross-sectional view depicted in FIG. 3B except that the compression nut is rotated thirty degrees.
Figure 3D:
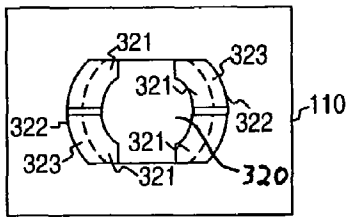
FIG. 3D is an end-on cross-sectional view illustrating the electrical contact, and the external threads and the external taper of the split barrel clamp depicted in FIG. 3A.
Figure 3G:
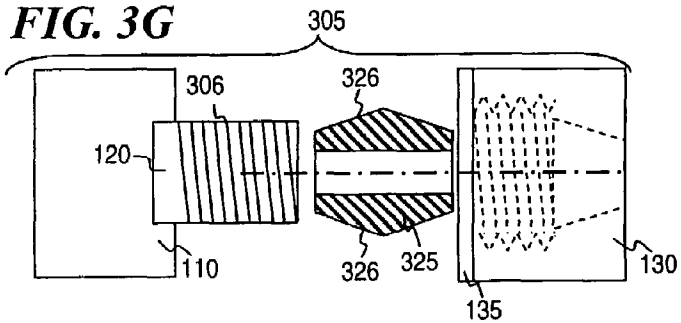
FIG. 3G is a side-view of the FIG. 3F assembly illustrating the electrical contact, the split barrel clamp, the ferrule, the compression nut, and the circular collar.
Figure 3A:
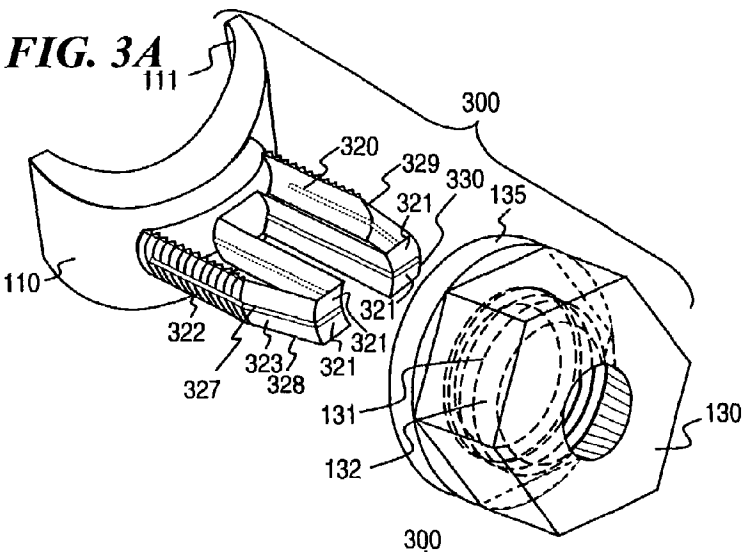
FIG. 3A is a perspective view that illustrates an assembly which combines an electrical contact, a compression nut, and a split barrel clamp.

FIG. 3A is a perspective view that illustrates an assembly 300 which combines the electrical contact 110, the compression nut 130, and a split barrel cable clamp 320. In some embodiments, as shown in FIG. 3A, each side of the split barrel clamp 320 is further split (at least partially) into two arms 327 and 328 on the left, and 329 and 330 on the right, giving the split barrel clamp 320 a total of four individual arms. In some embodiments, the electrical contact 110 includes a curved inside edge 111 that conforms the contact 110 around a conically-shaped battery post. In some embodiments, the split barrel clamp 320 has external threads 322 which receive and mate with internal threads 131 of the compression nut 130. In some embodiments, the compression nut 130 includes a circular collar 135 which prevents the hex points of the compression nut 130 from contacting the surface of the battery. In some embodiments, the split barrel clamp 320 has an externally tapered end 323 which is inserted into an internal taper 132 within the compression nut 130. The end faces 321 of the barrel clamp 320 are also depicted in FIG. 1A. In some embodiments, the taper 132 of the compression nut 130 is greater than the taper 323 of the barrel clamp 320 such that when the compression nut 130 is tightened onto the barrel clamp 320, the barrel clamp 320 is compressed onto the electrical cable.

FIG. 3B is a cross-sectional view of the assembly 300 showing the relative position of the split barrel clamp 320 and the electrical contact 110 to the internal features of the compression nut 130 and to the circular collar 135. The internal threads 131 of the compression nut 130 and the internal taper 132 of the compression nut 130 are also depicted.

FIG. 3C shows the same cross-sectional view of assembly 300 shown in FIG. 3B except that the compression nut 130 is rotated thirty degrees.

FIG. 3D is an end-on cross-sectional view illustrating the electrical contact 110, and the external threads 322 and the external taper 323 of the split barrel clamp 320. The end faces 321 of the barrel clamp 320 are also depicted.

Figure 3E:
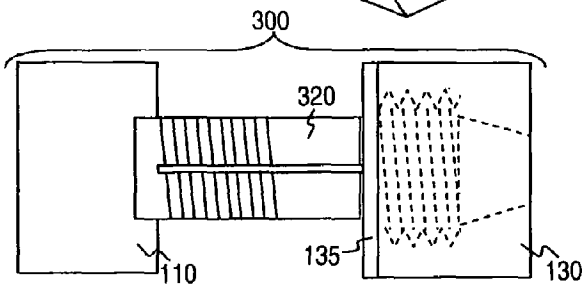
FIG. 3E is a side view of the FIG. 3A assembly illustrating the electrical contact, the split barrel clamp, the compression nut (the compression nut is rotated thirty degrees compared to the alignment of the compression nut in FIG. 3A), and the circular collar.

FIG. 3E is a side view of the assembly 300 illustrating the electrical contact 110, the split barrel clamp 320, the compression nut 130 (the compression nut 130 is rotated 30 degrees compared to the alignment of the compression nut 130 in FIG. 3A), and the circular collar 135.

Figure 3F:
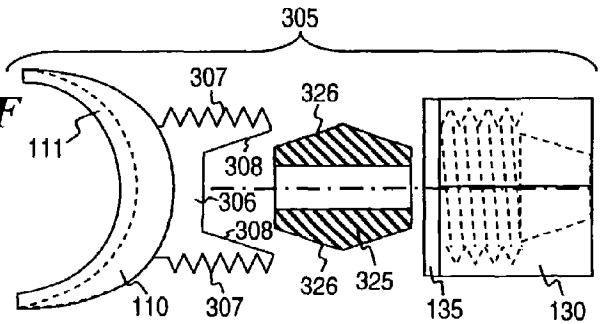
FIG. 3F provides a plan view (top view) of an assembly including the electrical contact (with a curved inside edge), a split barrel clamp, a ferrule, a compression nut, and a circular collar.

FIG. 3F provides a plan view (top view) of an assembly 305 including the electrical contact 110 (with curved inside edge 111), a split barrel clamp 306, a ferrule 325, the compression nut 130 (the compression nut 130 is rotated 30 degrees compared to the alignment of the compression nut 130 in FIG. 1A), and the circular collar 135. The external threads 307 of the split barrel clamp 306 are also depicted. In contrast to the barrel clamps 120 and 320, the barrel clamp 306 has internally tapered edges 308. The tapered edges 326 of the ferrule 325 fit into the tapered edges 308 of the barrel clamp 306 such that when an electrical cable is inserted through the compression nut 130, through the ferrule 325, and into the barrel clamp 306, and the compression nut 130 is tightened, the ferrule 325 is compressed around the cable. Once compressed around the electrical cable, the ferrule 325, which cannot itself pass through the compression nut 130, helps prevent the electrical cable from slipping out of assembly 305. In some embodiments, the arrangement of FIG. 1A or FIG. 3A, where the cable directly contacts the FIG. 3G is a side-view of assembly 305 illustrating the electrical contact 110, the split barrel clamp 306, the ferrule 325, the compression nut 130 (the compression nut 130 is rotated 30 degrees compared to the alignment of the compression nut 130 in FIG. 1A), and the circular collar 135.

Figure 4:
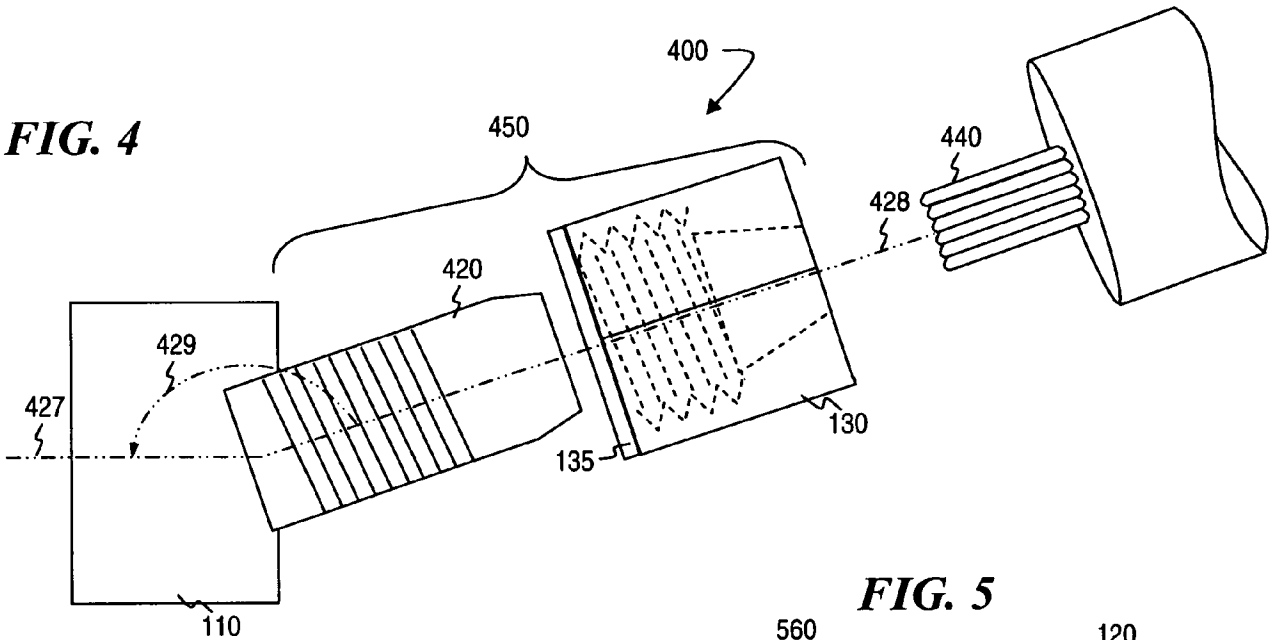
FIG. 4 is a side view illustrating an assembly which includes an electrical contact, an angled clamping unit (which includes a barrel clamp, a compression nut, and a circular collar), and an electrical cable.

FIG. 4 is a side view illustrating an assembly 400 which includes electrical contact 110, a clamping unit 450 (which includes a barrel clamp 420, the compression nut 130, and the circular collar 135), and an electrical cable 440. In some embodiments, the clamping unit 450 is configured to integrate with the electrical contact 110 such that an axis 428 of the electrical cable 440 is at an obtuse angle 429 relative to an axis 427 through the electrical contact 110. In some embodiments, the obtuse angle 429 allows for easier tool access to the compression nut 130.

Figure 5:
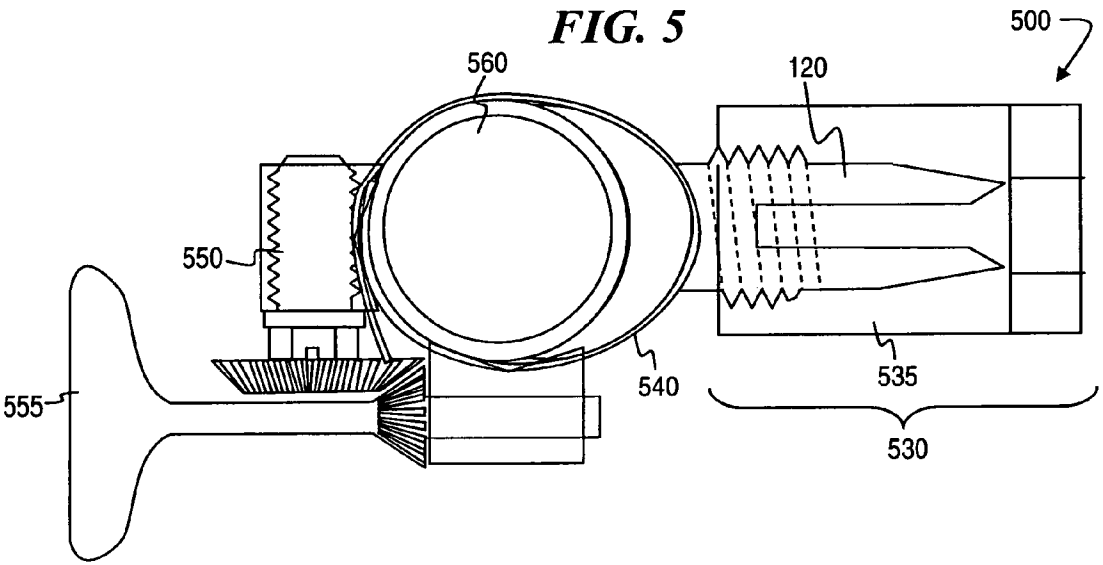
FIG. 5 is a top view of an assembly comprised of an electrical contact, a split barrel clamp, and a compression nut assembled in combination with a band clamp battery connector.

FIG. 5 is a top view of an assembly 500 comprised of the electrical contact 110, the split barrel clamp 120, and a compression nut 530 assembled in combination with a band clamp battery connector. The assembly 500 is shown attached to a battery post 560. In some embodiments, the compression nut 530 includes a cylindrical collar 535. The cylindrical collar 535 strengthens the connection between the compression nut 530 and the barrel clamp 120 because it provides a uniform thickness around the connection threads. The uniform thickness substantially eliminates weak spots in the connection caused by the hexagon shape of the compression nut 530. In some embodiments, the compression nut 530 and the cylindrical collar 535 are made from a high-strength composite polymer. In some embodiments, the composite polymer is used to insulate the barrel clamp 120.

In some embodiments, the band clamp includes a band 540, a worm drive adjustment screw 550, and a lobed handle 555. The lobed handle 555 provides a mechanically advantaged mechanism for quickly and easily hand-tightening (and hand-loosening) the band clamp around the battery post. In some embodiments, lobed handle 555 to the side as shown, while in other embodiments, is angled upward in order that it can be tightened from above. The band 540 of the band clamp has a hole cut through its center which allows the split barrel clamp 120 to pass through. The electrical contact 110 remains on the inside of the band 540 as it is too large to pass through. In some embodiments, the electrical contact 110 is attached to the band 540 with a fastener such as a rivet. In some embodiments, the hole that is cut through the band 540 is cut with flatted (i.e., flattened) sides in order to leave a wider portion of the band 540 on each side of the split barrel clamp 120. This can also help prevent rotation of the assembly 500 when the compression nut 530 is tightened to secure the electrical cable within the split barrel clamp 120.

Figure 6B:
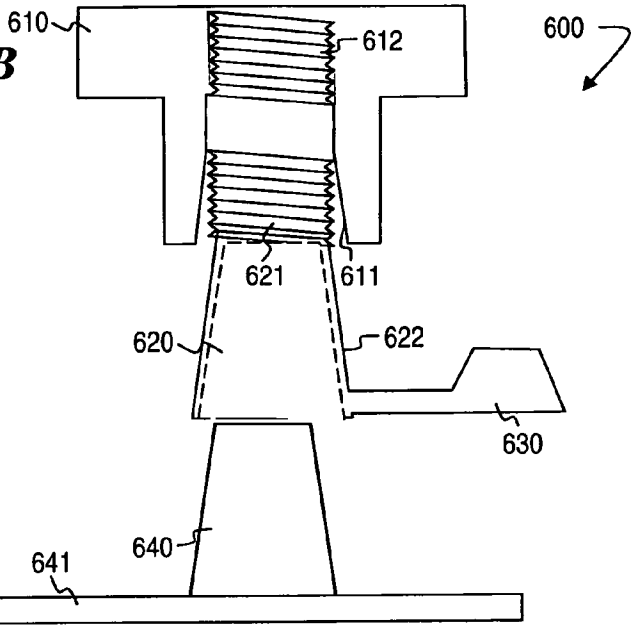
FIG. 6B is a side view of the FIG. 6A assembly.
Figure 6C:
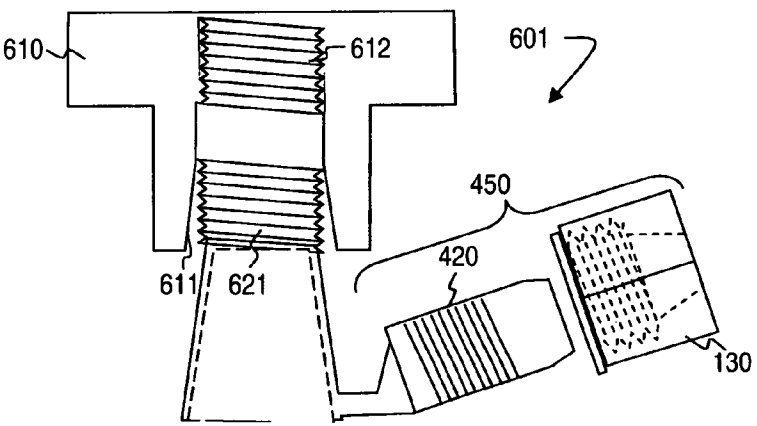
FIG. 6C is a side view of an assembly 601.
Figure 6A:
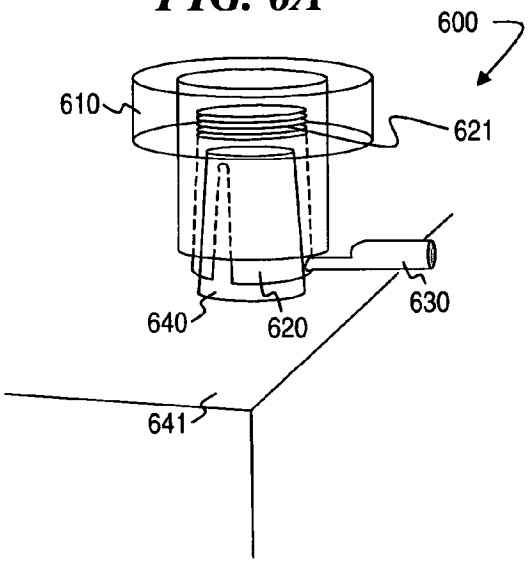
FIG. 6A is a perspective view of a quick-release, top-fitting compressive battery connector assembly for connecting to a battery post of a battery.

FIG. 6A is a perspective view of a quick-release, top-fitting compressive battery connector assembly 600 for connecting to a battery post 640 of a battery 641. In some embodiments, the assembly 600 includes a handle grip 610, a tapered collet 620, and a cable lug 630 which is electrically connected to the tapered collet 620. In some embodiments, as shown in FIG. 6A, the tapered collet 620 includes a male-threaded top 621. In some embodiments, the cable lug 630 includes a crimped-on electrical connector.

FIG. 6B is a side view of assembly 600. In some embodiments, the handle grip 610 includes an internal tapered collar 611 with female threads 612. In some embodiments, the tapered collet 620 includes an external taper 622 and the male-threaded top 621. In some embodiments, the collet 620 is compressed onto the battery post 640 by tightening the handle grip 610 onto the collet 620. The compressed connection between the battery post 640 and the collet 620 thus provides continuous electrical contact between the battery 641 and an electrical device connected via the cable lug 630.

In some embodiments, the operation of assembly 600 involves three quick steps: (1) Push the assembly 600 onto the battery post 640; (2) Tighten the handle grip 610 clockwise while pushing down to tighten on the battery post 640; and (3) Twist the handle grip 610 counter clockwise to remove assembly 600 from the battery post 640.

FIG. 6C is a side view of an assembly 601. The assembly 601 includes the same structures as the assembly 600 except that, in some embodiments, as shown in FIG. 6C, the cable lug 630 is replaced by the angled clamping unit 450 illustrated in FIG. 4.

Figure 7:
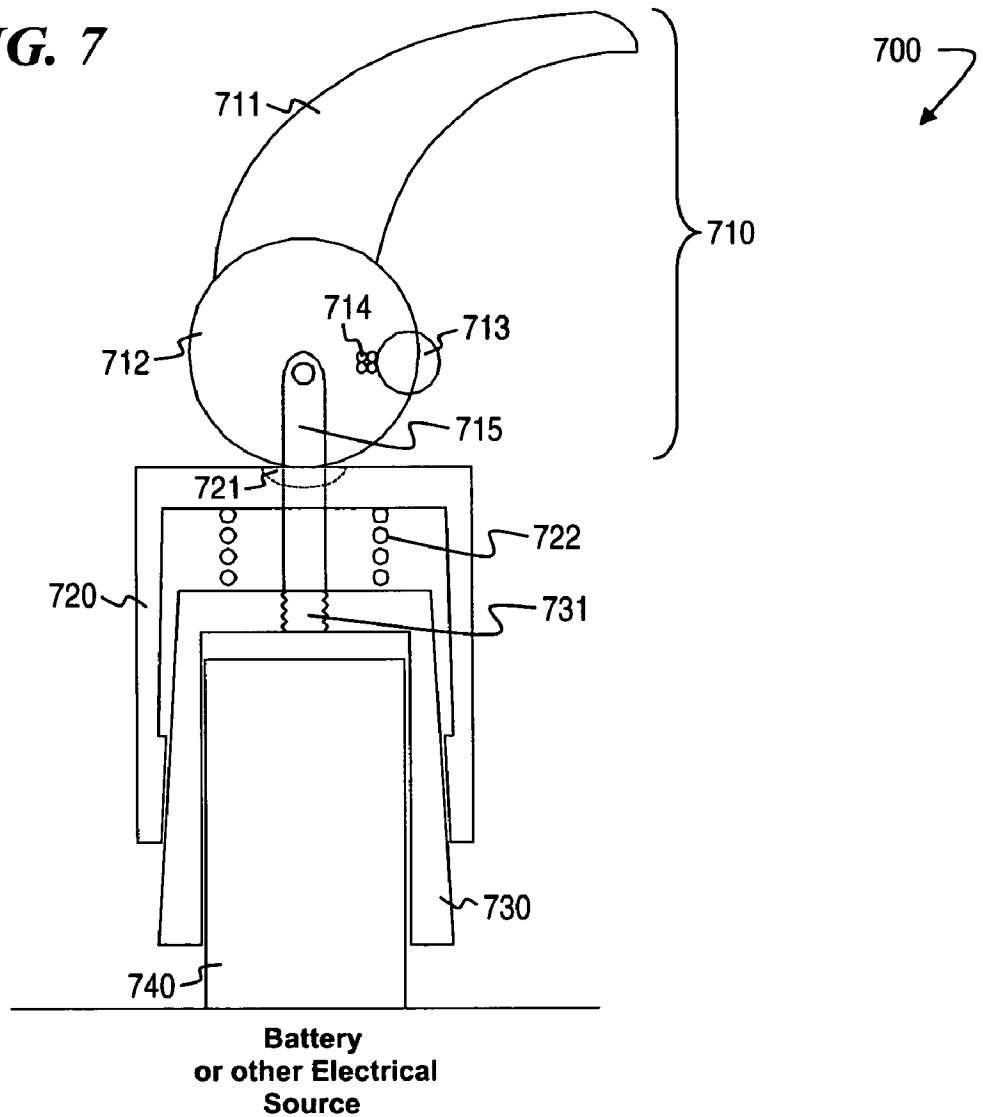
FIG. 7 illustrates a lever-actuated, quick-release, top-fitting compressive battery connector assembly.

FIG. 7 illustrates a lever-actuated, quick-release, top-fitting compressive battery connector assembly 700. In some embodiments, the assembly 700 includes a lever device 710, a compression collar 720, and a split collet 730. In some embodiments, the assembly 700 provides a mechanically advantaged mechanism for quickly connecting (and releasing) the split collet 730 to (and from) an electrical post 740. In some embodiments, as illustrated in FIG. 7, the assembly 700 fits on a straight electrical post. In some embodiments, the assembly 700 fits on a conically-shaped electrical post. In some embodiments, the compression collar 720 includes beveled sides.

In some embodiments, the lever device 710 is connected to the compression collar 720 and the compression collar 720/lever device 710 combination is mechanically attached to the split collet 730 via a slide shaft 715 which runs from the cam 712 of the lever device 710 to internal threads 731 on the top of the split collet 730. In some embodiments, the bottom of the slide shaft 715 also includes a set of threads which allows the shaft 715 to screw into the split collet 730. In some embodiments, the length of the slide shaft 715 is such that after the shaft 715 is completely screwed into the split collet 730, the compression collar 720 only partially compresses the split collet 730. In some embodiments, therefore, the partial compression formed by screwing the shaft 715 and the split collet 720 together allows the entire assembly 700 to be slipped onto the electrical post 740.

In some embodiments, the remaining compression required to complete the connection between the assembly 700 and the electrical post 740 is achieved by locking the lever arm 711 in place. In some embodiments, locking the lever arm 711 in place pulls the compression collar 720 down over substantially all of the split collet 730 such that the split collet 730 is completely compressed around the electrical post 740. In some embodiments, the lever arm 711 is locked into place by pulling the lever arm 711 down until a ball bearing 713 attached to the cam 712 is captured by a recess 721 located at the top of the compression collar 720, wherein the ball bearing 713, spring 714 and recess 721 together form a detent that holds the lever arm in the "down" position when it is rotated to that position. In some embodiments, pulling the lever arm 711 down rotates the cam 712 such that the shaft 715 pulls the compression collar 720 over the split collet 730 as explained above. In some embodiments, a set of one or more springs 722 located between the underside of the compression collar 720 and the top of the split collet 730 provides resistance such that when the lever arm is released from its locked position, the compression collar 720 is quickly pulled off (at least partially) of the split collet 730, and thus, the entire assembly 700 can quickly be removed from the electrical post 740. In some embodiments, a set of one or more springs 714 located between the cam 712 and the ball bearing 713 provides the necessary resistance needed to lock both the lever and the cam in place.

In some embodiments the electrical connector may be a battery cable connector with an electrical contact configured to mate with a battery post.

In some embodiments the electrical connector may be a power connector whose electrical contact is either a standard socket or pin configuration employing the subject split barrel clamp to secure the wire.

In some embodiments, the present invention provides an apparatus for securing an electrical cable to an electrical contact, wherein the apparatus includes a barrel clamp, wherein the barrel clamp includes external threads and an external taper, a compressive nut, wherein the compressive nut includes internal threads and an internal taper, wherein the external threads and the external taper of the barrel clamp are configured to mate with the internal threads and the internal taper of the compressive nut, and wherein the barrel clamp is compressed around the electrical cable when the compressive nut is tightened to the barrel clamp, and an electrical contact, wherein the electrical contact is integrated with the barrel clamp.

In some embodiments, the barrel clamp is split into two or more compressible segments. In some embodiments, the barrel clamp is integrated with the electrical contact at an angle relative to a horizontal plane of the electrical contact.

In some embodiments, the apparatus further includes a band clamp, wherein the band clamp includes an adjustable worm-drive screw, and wherein the band clamp includes a band containing a flatted hole cut through its center to allow the barrel clamp to pass through, wherein the barrel clamp is externally flatted to mate with the flatted hole in the band, wherein the electrical contact is configured to mate with a tapered battery post, wherein the electrical contact is integrated with the barrel clamp, and wherein the electrical contact is sized such that it cannot pass through the flatted hole in the band.

In some embodiments, the electrical contact is configured to attach to the band of the band clamp by recessed rivets.

In some embodiments, the compression nut includes a cylindrical body, and wherein the internal threads and the internal taper of the compression nut are contained within the cylindrical body. In some embodiments, the compressive nut includes an external hexagonal shape such that the nut can receive a conventional tightening tool.

In some embodiments, the electrical contact is substantially shaped to mate with a tapered battery post.

In some embodiments, the barrel clamp and the electrical contact constitute a single piece of conductive material. In some embodiments, the barrel clamp and the electrical contact constitute two separate pieces of conductive material. In some embodiments, the barrel clamp is configured to attach to the electrical contact by a threaded connection. In some embodiments, the barrel clamp is configured to attach to the electrical contact by a compression mechanism.

In some embodiments, the present invention provides a quick-release apparatus for securing an electrical contact to an electrical post, wherein the apparatus includes a compression nut, wherein the compression nut includes a tapered collar, and wherein the tapered collar includes internal threads and an internal taper, an electrical contact, wherein the electrical contact includes a threaded top and an external taper such that the threaded top and the external taper of the electrical contact are configured to mate with the internal threads and the internal taper of the tapered collar in a vertically-mounted position, and wherein the electrical contact is compressed around the electrical post when the compression nut is tightened to the electrical contact, and a cable lug, wherein the cable lug is integrated with the electrical contact.

In some embodiments, the electrical contact is split into two or more compressible segments.

In some embodiments, the present invention provides a lever-actuated, quick-release apparatus for securing an electrical post to an electrical contact, wherein the apparatus further includes a cam, a lever arm, wherein the lever arm is configured to attach to the cam; and wherein the lever arm is configured to provide a mechanically advantaged compression movement, a ball bearing, wherein the ball bearing is configured to attach to an outer rim of the cam such that a first part of the ball bearing is located within the outer rim and second part of the ball bearing protrudes beyond the outer rim, and wherein the ball bearing includes a first set of one or more springs configured to provide resistance to movement of the ball bearing into the outer rim of the cam, an electrical contact, wherein the electrical contact includes internal threads located at the top of the electrical contact, and wherein the electrical contact is configured to connect to an electrical post via a top end of the electrical post, a slide shaft, wherein a first end of the slide shaft includes external threads that are configured to mate with the internal threads of the electrical contact, and wherein a second end of the slide shaft is configured to connect the slide shaft to the cam, a compression collar, wherein the compression collar is configured to attach to the slide shaft such that the slide shaft provides a mechanical connection between the compression collar and the electrical contact, wherein the compression collar includes a detent that is configured to capture the ball bearing during operation of the lever arm such that the cam is locked into place when the lever arm completes its movement, and wherein the operation of the lever arm causes the compression collar to move over the electrical contact and compress the electrical contact such that when the cam is locked into place, a substantially uniform electrical connection is made between the electrical contact and the electrical post, and a second set of one or more springs, wherein the second set of one or more springs is configured to connect a top of the electrical contact to an underside of the compression collar, wherein the second set of one or more springs is configured to provide resistance to movement of the compression collar over the electrical contact such that when the cam is released from a locked position, the compression collar is quickly and easily removed from the electrical contact, thereby allowing the electrical contact to be slipped off of the electrical post.

In some embodiments, the electrical contact includes two or more compressible segments.

In some embodiments, the present invention provides a method of securing an electrical cable to an electrical contact, wherein the method includes providing a barrel clamp, wherein the barrel clamp includes external threads and an external taper, placing a compressive nut around a first end of the barrel clamp, wherein the compressive nut includes a hole such that an electrical cable can pass through the hole, wherein the compressive nut includes internal threads and an internal taper, wherein the external threads and the external taper of the barrel clamp are configured to mate with the internal threads and the internal taper of the compressive nut, inserting the electrical cable through the hole of the compressive nut and into the first end of the barrel clamp, wherein a second end of the barrel clamp is attached to an electrical contact, and compressing the barrel clamp around the electrical cable, wherein the compressing of the barrel clamp includes tightening the compressive nut around the first end of the barrel clamp.

In some embodiments, the providing of the barrel clamp includes providing a barrel clamp that is split into two or more compressible segments. In some embodiments, the providing of the barrel clamp includes providing a barrel clamp that is configured to attach to the electrical contact at an angle relative to a horizontal plane of the electrical contact.

In some embodiments, the method further includes configuring the electrical contact to mate with a tapered battery post, and attaching the electrical contact to a band clamp, wherein the band clamp includes an adjustable worm-drive screw, wherein the band clamp includes a band containing a flatted hole cut through its center to allow the barrel clamp to pass through; wherein the barrel clamp is externally flatted to mate with the flatted hole in the band; and wherein the electrical contact is sized such that it cannot pass through the flatted hole in the band.

In some embodiments, the configuring of the electrical contact includes configuring the contact to attach to the band of the band clamp by recessed rivets.

In some embodiments, the method further includes configuring the compression nut to include a cylindrical body, wherein the internal threads and the internal taper of the compression nut are contained within the cylindrical body. In some embodiments, the method further includes configuring the compressive nut to include an external hexagonal shape such that the nut can receive a conventional tightening tool. In some embodiments, the method further includes configuring the electrical contact to mate with a tapered battery post. In some embodiments, the method further includes manufacturing the barrel clamp and the electrical contact out of a single piece of conductive material. In some embodiments, the method further includes manufacturing the barrel clamp out of a first piece of conductive material and manufacturing the electrical contact out of a second piece of conductive material.

In some embodiments, the manufacturing of the barrel clamp and the electrical contact includes configuring the barrel clamp to attach to the electrical contact by a threaded connection. In some embodiments, the manufacturing of the barrel clamp and the electrical contact includes configuring the barrel clamp to attach to the electrical contact by a compression mechanism.

In some embodiments, the present invention provides an apparatus for securing an electrical cable to an electrical contact, wherein the apparatus includes an electrical contact that includes an integrated barrel clamp, wherein the barrel clamp includes external threads and an external taper and an internal bore configured to receive an end of the electrical cable, and a cable compressive nut, wherein the compressive nut includes internal threads and an internal taper, and wherein the external threads and the external taper of the barrel clamp are configured to mate with the internal threads and the internal taper of the compressive nut such that the barrel clamp compresses around the electrical cable when the compressive nut is tightened on the barrel clamp.

In some embodiments, the barrel clamp includes two or more segments, at least one of which is a tapered ferrule that compresses around the electrical cable when the compressive nut is tightened on the barrel clamp. In some embodiments, the barrel clamp is configured to integrate with the electrical contact such that an axis of the electrical cable is at an obtuse angle relative to an axis through the electrical contact.

In some embodiments, the apparatus further includes a band clamp, wherein the band clamp includes an adjustable worm-drive screw, and wherein the band clamp includes a band containing a flatted hole cut through its center to allow the barrel clamp to pass through, wherein the barrel clamp is configured to fit through the flatted hole in the band, and wherein the electrical contact is configured to conform to a tapered battery post.

In some embodiments, the compression nut includes a cylindrical body portion, wherein the internal threads and the internal taper of the compression nut are contained within the cylindrical portion.

In some embodiments, the electrical contact further includes a battery-post compression nut, wherein the battery-post compression nut includes internal threads and an internal taper, and a battery-post electrical contact, wherein the battery-post electrical contact includes a threaded top and an external taper such that the threaded top and the external taper of the electrical contact are configured to mate with the internal threads and the internal taper of the battery-post compression nut in a vertically-mounted position such that the electrical contact is compressed around the electrical post when the compression nut is tightened on the electrical contact.

In some embodiments, the electrical contact further includes a cam, a lever arm, wherein the lever arm is configured to attach to the cam; and wherein the lever arm is configured to provide a mechanically advantaged compression movement, a ball-bearing detent unit that includes a ball bearing, wherein the ball-bearing detent unit is configured to attach to an outer rim of the cam such that a first part of the ball-bearing detent unit is located within the outer rim and second part of the ball bearing unit protrudes beyond the outer rim, and wherein the ball-bearing detent unit includes a first set of one or more springs configured to provide resistance to movement of the ball-bearing detent unit into the outer rim of the cam, an electrical contact, wherein the electrical contact includes internal threads located at the top of the electrical contact, and wherein the electrical contact is configured to connect to an electrical post via a top end of the electrical post, a slide shaft, wherein a first end of the slide shaft includes external threads that are configured to mate with the internal threads of the electrical contact, and wherein a second end of the slide shaft is configured to connect the slide shaft to the cam, a compression collar, wherein the compression collar is configured to attach to the slide shaft such that the slide shaft provides a mechanical connection between the compression collar and the electrical contact, wherein the compression collar includes a recess that is configured to capture the ball bearing during operation of the lever arm such that the cam is locked into place when the lever arm completes its movement, and wherein the operation of the lever arm causes the compression collar to move over the electrical contact and compress the electrical contact such that when the cam is locked into place, a substantially uniform electrical connection is made between the electrical contact and the electrical post, and a second set of one or more springs, wherein the second set of one or more springs is configured to connect a top of the electrical contact to an underside of the compression collar, and wherein the second set of one or more springs is configured to provide resistance to movement of the compression collar over the electrical contact such that when the cam is released from a locked position, the compression collar is quickly and easily removed from the electrical contact, thereby allowing the electrical contact to be slipped off of the electrical post.

In some embodiments, the present invention provides a method of electrically connecting and mechanically securing an electrical cable to an electrical contact, wherein the method includes providing an electrical contact connected to a barrel clamp, wherein the barrel clamp includes external threads and an external taper and an internal bore configured to receive an end of the electrical cable, providing a compressive nut, wherein the compressive nut includes a through opening, wherein the compressive nut includes internal threads and an internal taper, wherein the external threads and the external taper of the barrel clamp are configured to mate with the internal threads and the internal taper of the compressive nut, placing the compressive nut on a first end of the barrel clamp, inserting the electrical cable through the opening of the compressive nut and into the internal bore of the barrel clamp, and compressing the barrel clamp around the electrical cable, wherein the compressing of the barrel clamp includes tightening the compressive nut on the first end of the barrel clamp.

In some embodiments, the providing of the barrel clamp includes providing two or more segments, at least one of which is a tapered ferrule that compresses around the electrical cable when the compressive nut is tightened on the barrel clamp.

In some embodiments, the method further includes angling the barrel clamp relative to the electrical contact such that an axis of the electrical cable is at an obtuse angle relative to an axis through the electrical contact.

In some embodiments, the method further includes providing a band clamp, wherein the band clamp includes an adjustable worm-drive screw, wherein the band clamp includes a band containing a flatted hole cut through its center to allow the barrel clamp to pass through; wherein the barrel clamp is externally flatted to mate with the flatted hole in the band; and wherein the electrical contact is sized such that it cannot pass through the flatted hole in the band, configuring the electrical contact to mate with a tapered battery post, and attaching the electrical contact and the band clamp to the battery post and tightening the band clamp.

In some embodiments, the method further includes configuring the compression nut to include a cylindrical body, wherein the internal threads and the internal taper of the compression nut are contained within the cylindrical body.

In some embodiments, the method further includes manufacturing the barrel clamp and the electrical contact out of a single piece of conductive material. In some embodiments, the method further includes manufacturing the barrel clamp out of a first piece of conductive material and manufacturing the electrical contact out of a separate second piece of conductive material.

Markets for the Present Invention

The present invention provides a plurality of advantages that allow it to be used/produced in a large variety of ways. For example, in some embodiments, the present invention is used as a retrofit apparatus. For example, in some embodiments, an existing wiring harness is used by cutting off the old connector, stripping the wire, and inserting the wire into the present invention. In some embodiments, due to the ease of installation, the present invention is produced by an original equipment manufacturer. In some embodiments, the military makes use of the present invention due to its high reliability and ease of use. In some embodiments, the present invention is used for marine equipment due to its associated corrosion resistance (i.e., due to fewer interfaces or joints between metal pieces in the electrical path).

GENERAL ADVANTAGES OF THE PRESENT INVENTION

As a first matter the present invention provides the following advantages: it never deforms or fatigues, it's corrosion resistant, it has a primary (copper or brass) and a secondary (stainless) current path, many tools can be used to remove and install it (e.g., hex wrench, flat screw driver, Phillips screw driver, etc.), and it looks cleaner and more attractive than other electrical connectors. Another key advantage to the present invention is that, although some embodiments make use of materials containing a tin coating that is galvanometrically close to lead, it does not actually use lead. The more the use of lead continues to become restricted, the more environmentally friendly materials, like those used to make the present invention, will be favored. The present invention also provides the advantage that it is more reliable and robust than other current battery connectors. In addition, the present invention is easier to remove and install than other current battery connectors. For example, in some embodiments, all it takes to loosen or tighten the clamp around the electrical cable is a quick turn of a worm drive screw.

In some embodiments, the present invention provides an apparatus for securing an electrical cable to an electrical contact, the apparatus including an electrical contact that includes an integrated barrel clamp, wherein the barrel clamp includes external threads and an external taper and an internal bore configured to receive an end of the electrical cable; a cable compressive nut, wherein the compressive nut includes internal threads and an internal taper, wherein the external threads of the barrel clamp are configured to mate with the internal threads of the compressive nut, and the barrel clamp and the compressive nut are configured such that the barrel clamp compresses around the electrical cable when the compressive nut is tightened on the barrel clamp.

In some embodiments, the present invention provides a method of electrically connecting and mechanically securing an electrical cable to an electrical contact, the method including providing an electrical contact connected to a barrel clamp, wherein the barrel clamp includes external threads and an external taper and an internal bore configured to receive an end of the electrical cable; providing a compressive nut, wherein the compressive nut includes a through opening, wherein the compressive nut includes internal threads and an internal taper, wherein the external threads of the barrel clamp are configured to mate with the internal threads of the compressive nut; placing the compressive nut on a first end of the barrel clamp; inserting the electrical cable through the opening of the compressive nut and into the internal bore of the barrel clamp; and compressing the barrel clamp around the electrical cable, wherein the compressing of the barrel clamp includes tightening the compressive nut on the first end of the barrel clamp.

In some embodiments, the present invention provides an apparatus for securing an electrical cable to an electrical contact, the apparatus including an electrical contact; means for compressing onto an electrical cable and rotating means for forcing the means for compressing against the electrical cable, wherein the means for compressing is attached to the electrical contact, such that an electrical and mechanical connection is formed between the electrical contact and the electrical cable by the means for compressing and the means for forcing.

In some embodiments, the rotating means surrounds the means for compressing, wherein the means for compressing has two or more segments, at least one of which is a tapered ferrule that compresses around the electrical cable when the barrel-clamp means connects the electrical cable to the electrical contact.

In some embodiments, the means for compressing is configured at an obtuse angle relative to the electrical contact such that an axis of the electrical cable is at the obtuse angle relative to an axis through the electrical contact.

Some embodiments further include means for band clamping the electrical contact with a battery post, wherein the means for band clamp includes an adjustable worm-drive screw.

In some embodiments, the means for compressing includes a compression nut having a cylindrical body portion. In some embodiments, the means for compressing and the electrical contact are manufactured out of a single piece of metal.

It is specifically contemplated that some embodiments of the invention include combinations of the various separately described embodiments described above, and/or subcombinations that omit one or more features of certain embodiments.

It is to be understood that the above description is intended to be illustrative, and not restrictive. Although numerous characteristics and advantages of various embodiments as described herein have been set forth in the foregoing description, together with details of the structure and function of various embodiments, many other embodiments and changes to details will be apparent to those of skill in the art upon reviewing the above description. The scope of the invention should be, therefore, determined with reference to the appended claims, along with the full scope of equivalents to which such claims are entitled. In the appended claims, the terms "including" and "in which" are used as the plain-English equivalents of the respective terms "comprising" and "wherein," respectively. Moreover, the terms "first," "second," and "third," etc., are used merely as labels, and are not intended to impose numerical requirements on their objects.

What is claimed is:

1. An apparatus for securing an electrical cable to an electrical contact, the apparatus comprising:

an electrical contact that includes an integrated barrel clamp, wherein the barrel clamp includes external threads and an external taper and an internal bore configured to receive an end of the electrical cable, wherein the external threads include a minor diameter formed in and by a valley between two adjacent external thread ridges that extend to a major diameter, wherein the external taper reduces from a first taper diameter to a second taper diameter toward a far end of the barrel clamp, and wherein the second taper diameter is smaller than the minor diameter of the external threads;

a cable compressive nut, wherein the compressive nut includes internal threads and an internal taper, wherein the external threads of the barrel clamp are configured to mate with the internal threads of the compressive nut, and the barrel clamp and the compressive nut are configured such that the barrel clamp compresses around the electrical cable when the compressive nut is tightened on the barrel clamp.

2. The apparatus of claim 1, wherein the barrel clamp is configured to integrate with the electrical contact such that an axis of the electrical cable is at an obtuse angle relative to an axis through the electrical contact.

3. The apparatus of claim 1, wherein the compression nut includes a cylindrical body portion, and wherein the internal threads and the internal taper of the compression nut are contained within the cylindrical portion.

4. The apparatus of claim 1, the electrical contact further comprising:

a battery-post compression nut, wherein the battery-post compression nut includes internal threads and an internal taper;

a battery-post electrical contact, wherein the battery-post electrical contact includes a threaded top and an external taper such that the threaded top and the external taper of the electrical contact are configured to mate with the internal threads and the internal taper of the battery-post compression nut in a vertically-mounted position such that the electrical contact is compressed around the electrical post when the compression nut is tightened on the electrical contact.

5. The apparatus of claim 1, the electrical contact further comprising:

a cam;

a lever arm, wherein the lever arm is configured to attach to the cam; and wherein the lever arm is configured to provide a mechanically advantaged compression movement;

a ball-bearing detent unit that includes a ball bearing, wherein the ball-bearing detent unit is configured to attach to an outer rim of the cam such that a first part of the ball-bearing detent unit is located within the outer rim and second part of the ball bearing unit protrudes beyond the outer rim, and wherein the ball-bearing detent unit includes a first set of one or more springs configured to provide resistance to movement of the ball-bearing detent unit into the outer rim of the cam;

an electrical contact, wherein the electrical contact includes internal threads located at the top of the electrical contact, and wherein the electrical contact is configured to connect to an electrical post via a top end of the electrical post;

a slide shaft, wherein a first end of the slide shaft includes external threads that are configured to mate with the internal threads of the electrical contact, and wherein a second end of the slide shaft is configured to connect the slide shaft to the cam;

a compression collar, wherein the compression collar is configured to attach to the slide shaft such that the slide shaft provides a mechanical connection between the compression collar and the electrical contact, wherein the compression collar includes a recess that is configured to capture the ball bearing during operation of the lever arm such that the cam is locked into place when the lever arm completes its movement, and wherein the operation of the lever arm causes the compression collar to move over the electrical contact and compress the electrical contact such that when the cam is locked into place, a substantially uniform electrical connection is made between the electrical contact and the electrical post; and a second set of one or more springs, wherein the second set of one or more springs is configured to connect a top of the electrical contact to an underside of the compression collar, wherein the second set of one or more springs is configured to provide resistance to movement of the compression collar over the electrical contact such that when the cam is released from a locked position, the compression collar is quickly and easily removed from the electrical contact, thereby allowing the electrical contact to be slipped off of the electrical post.

6. The apparatus of claim 1, wherein the electrical contact and integrated barrel clamp are a single piece of metal.

7. An apparatus for securing an electrical cable to an electrical contact, the apparatus comprising:

an electrical contact that includes an integrated barrel clamp, wherein the barrel clamp includes external threads and an external taper and an internal bore configured to receive an end of the electrical cable;

a cable compressive nut, wherein the compressive nut includes internal threads and an internal taper, wherein the external threads of the barrel clamp are configured to mate with the internal threads of the compressive nut, and the barrel clamp and the compressive nut are configured such that the barrel clamp compresses around the electrical cable when the compressive nut is tightened on the barrel clamp; and a band clamp, wherein the band clamp includes an adjustable worm-drive screw, and wherein the band clamp includes a band containing a flatted hole cut through its center to allow the barrel clamp to pass through;

wherein the barrel clamp is configured to fit through the flatted hole in the band; and wherein the electrical contact is configured to conform to a tapered battery post.

8. An apparatus for securing an electrical cable to an electrical contact, the apparatus comprising:

an electrical contact; and means for compressing onto an electrical cable and rotating means for forcing the means for compressing against the electrical cable, wherein the means for compressing is attached to the electrical contact, such that an electrical and mechanical connection is formed between the electrical contact and the electrical cable by the means for compressing and the means for forcing.

9. The apparatus of claim 8, wherein the rotating means surrounds the means for compressing, wherein the means for compressing has two or more segments, at least one of which is a tapered ferrule that compresses around the electrical cable when the barrel-clamp means connects the electrical cable to the electrical contact.

10. The apparatus of claim 8, wherein the means for compressing is configured at an obtuse angle relative to the electrical contact such that an axis of the electrical cable is at the obtuse angle relative to an axis through the electrical contact.

11. The apparatus of claim 8, wherein the means for compressing includes a compression nut having a cylindrical body portion.

12. The apparatus of claim 8, wherein the means for compressing and the electrical contact are manufactured out of a single piece of metal.

13. An apparatus for securing an electrical cable to an electrical contact, the apparatus comprising:

an electrical contact;

means for compressing onto an electrical cable and rotating means for forcing the means for compressing against the electrical cable, wherein the means for compressing is attached to the electrical contact, such that an electrical and mechanical connection is formed between the electrical contact and the electrical cable by the means for compressing and the means for forcing; and means for band clamping the electrical contact with a battery post, wherein the means for band clamp includes an adjustable worm-drive screw.

14. An apparatus for securing an electrical cable to an electrical contact, the apparatus comprising:

an electrical contact that includes a barrel clamp, wherein the barrel clamp includes a threaded portion having external threads and an internal taper, and a compressible ferrule portion that includes a first external taper, a second external taper and an internal bore, and wherein the internal taper of the threaded portion is configured to mate with the second external taper of the ferrule portion; and a cable compressive nut, wherein the compressive nut includes internal threads and an internal taper, wherein the external threads of the barrel clamp are configured to mate with the internal threads of the compressive nut, wherein the first external taper of the ferrule portion is configured to mate with the internal taper of the compressive nut, and wherein the barrel clamp and the compressive nut are configured such that the ferrule portion of the barrel clamp compresses around the electrical cable when the compressive nut is tightened on the barrel clamp.

15. The apparatus of claim 14, wherein the electrical contact includes a first axis, wherein the electrical contact includes a curved inside edge that conforms to a circumference around the first axis, and wherein the barrel clamp has a longitudinal axis that is at an obtuse angle relative to a line perpendicular to the first axis and directed generally away from the curved inside edge.

16. The apparatus of claim 14, wherein the compressive nut includes a hexagonal external tool-reception surface.

17. The apparatus of claim 14, wherein the compressive nut includes a cylindrical body portion, and wherein the internal threads and the internal taper of the compressive nut are contained within the cylindrical body portion.

18. The apparatus of claim 14, wherein the compressive nut includes a cylindrical collar and an external tool-reception surface having a plurality of flats.

19. The apparatus of claim 14, wherein the barrel clamp includes two arms.

20. The apparatus of claim 19, wherein each arm of the barrel clamp is at least partially split into two arm portions such that the barrel clamp includes at least four individual arm portions.

* * * * *